US006944547B2

(12) United States Patent
Womer et al.

(10) Patent No.: US 6,944,547 B2
(45) Date of Patent: Sep. 13, 2005

(54) AUTOMATED RIG CONTROL MANAGEMENT SYSTEM

(75) Inventors: Keith Womer, Round Rock, TX (US); William I. Koederitz, Cedar Park, TX (US); Mallappa I. Guggari, Cedar Park, TX (US)

(73) Assignee: Varco I/P, Inc., Houston, TX (US)

( * ) Notice: Subject to any disclaimer, the term of this patent is extended or adjusted under 35 U.S.C. 154(b) by 192 days.

(21) Appl. No.: 10/625,933

(22) Filed: Jul. 24, 2003

(65) Prior Publication Data

US 2004/0153245 A1 Aug. 5, 2004

Related U.S. Application Data

(60) Provisional application No. 60/398,670, filed on Jul. 26, 2002.

(51) Int. Cl.[7] ..... E21B 44/06

(52) U.S. Cl. ..... 702/7; 175/57

(58) Field of Search ..... 702/7, 9, 16, 13; 703/5, 10; 73/152.2, 0.3; 175/19, 57, 45; 367/25

(56) References Cited

U.S. PATENT DOCUMENTS

| | | | | |
|---|---|---|---|---|
| 5,678,643 | A | 10/1997 | Robbins et al. | 175/45 |
| 5,842,149 | A | 11/1998 | Harrell et al. | 702/9 |
| 6,088,294 | A * | 7/2000 | Leggett et al. | 367/25 |
| 6,233,524 | B1 | 5/2001 | Harrell et al. | 702/9 |
| 6,553,316 | B2 * | 4/2003 | Bary et al. | 702/16 |
| 6,820,702 | B2 * | 11/2004 | Niedermayr et al. | 175/57 |
| 6,868,920 | B2 * | 3/2005 | Hoteit et al. | 175/25 |
| 2004/0088115 | A1 * | 5/2004 | Guggari et al. | 702/13 |

* cited by examiner

*Primary Examiner*—John Barlow
*Assistant Examiner*—Victor J. Taylor
(74) *Attorney, Agent, or Firm*—Guy McClung

(57) ABSTRACT

A system and method for controlling operation of a drilling rig having a control management system, comprises programming the control system with at least one resource module, the at least one resource module having at least one operating model having at least one set of programmed operating rules related to at least one set of operating parameters. In addition, the system and method provide an authenticating hierarchical access to at least one user to the at least one resource module.

25 Claims, 6 Drawing Sheets

EXAMPLES OF "RESOURCES" THAT CAN BE CHECKED OUT

1. TOOL CONTROLS (EACH CHECKED OUT INDIVIDUALLY)
   - TOP DRIVES
   - SCR CONTROLS
   - DRAWWORKS CONTROLS
2. ELECTRONIC DRILLING SYSTEM
   - RPM, WOB, TRQ, $\Delta P$
   - PUMP STROKES, DRAWWORKS
3. PRESSURE MANAGEMENT SYSTEM
   - PUMP STROKES
   - CHOKE CONTROL
4. SOLID CONTROL
   - PUMP STROKES
   - SHAKER CONTROL
   - CENTRIFUGE CONTROL
   - CHEMICAL ADDITIVE CONTROL
5. TRIPPING MANAGEMENT SYSTEM
   - DRAWWORKS, IRON ROUGHNECK
   - RPM
   - SWAB/SURGE LIMITS
6. DOWNHOLE TOOL CONTROL
   - PUMP STROKES
   - RPM
   - SEQUENCING SCHEMES

*FIG. 2*

USER AUTHORIZATION SCREEN

| MODIFY? | ORGANIZATION | USER | AUTHORIZATION | RESOURCES |
|---|---|---|---|---|
| ☐ | CONTRACTOR 1 | USER1 | PASSWORD | DOWNHOLE TOOL CONTROL |
| ☐ | CONTRACTOR 1 | USER2 | KEY-ACCESS | ELECTRONIC DRILLER |
| ☐ | CONTRACTOR2 | USER3 | SUPERVISED | TOP DRIVE & PIPE HANDLER |
| ☐ | CONTRACTOR3 | USER4 | PASSWORD W/MANUAL ACKNOWLEDGE | SWAB/SURGE CONTROL |

AUTOMATED RIG CONTROL MANAGEMENT SYSTEM

CROSS-REFERENCE TO RELATED APPLICATIONS

This application claims the priority of U.S. Provisional Patent application Ser. No. 60/398,670 filed Jul. 26, 2002.

BACKGROUND OF THE INVENTION

1. Field of the Invention

This invention relates generally to systems for drilling boreholes for the production of hydrocarbons and more particularly to an automated rig control management system having a hiearchical and authenticating communication interface to the various service contractor and rig operation inputs and using a control model for allocating and regulating rig resources according to operating rules programmed into the control management system to achieve the desired well plan within the operational constraints of the drilling rig equipment and borehole.

2. Description of the Related Art

To obtain hydrocarbons such as oil and gas, boreholes are drilled by rotating a drill bit attached at a drill string end. A large proportion of the current drilling activity involves directional drilling, i.e., drilling deviated and horizontal boreholes, to increase the hydrocarbon production and/or to withdraw additional hydrocarbons from the earth's formations. Modern directional drilling systems generally employ a drill string having a bottomhole assembly (BHA) and a drill bit at end thereof that is rotated by a drill motor (mud motor) and/or the drill string. A number of downhole devices placed in close proximity to the drill bit measure certain downhole operating parameters associated with the drill string. Such devices typically include sensors for measuring downhole temperature and pressure, azimuth and inclination measuring devices and a resistivity-measuring device to determine the presence of hydrocarbons and water. Additional downhole instruments, known as logging-while-drilling ("LWD") and/or measurement-while drilling ("MWD") tools, are frequently attached to the drill string to determine the formation geology and formation fluid conditions during the drilling operations.

Pressurized drilling fluid (commonly known as the "mud" or "drilling mud") is pumped into the drill pipe to rotate the drill motor and to provide lubrication to various members of the drill string including the drill bit. The drill pipe is rotated by a prime mover, such as a motor, to facilitate directional drilling and to drill vertical boreholes.

Boreholes are usually drilled along predetermined paths and the drilling of a typical borehole proceeds through various formations. The drilling operator typically controls the surface-controlled drilling parameters, such as the weight on bit, drilling fluid flow through the drill pipe, the drill string rotational speed (rpm of the surface motor coupled to the drill pipe) and the density and viscosity of the drilling fluid to optimize the drilling operations. The downhole operating conditions continually change and the operator must react to such changes and adjust the surface-controlled parameters to optimize the drilling operations.

For drilling a borehole in a virgin region, the operator typically has seismic survey plots that provide a macro picture of the subsurface formations and a pre-planned borehole path. For drilling multiple boreholes in the same formation, the operator also has information about the previously drilled boreholes in the same formation. Additionally, various downhole sensors and associated electronic circuitry deployed in the BHA continually provide information to the operator about certain downhole operating conditions, condition of various elements of the drill string and information about the formation through which the borehole is being drilled.

Typically, the information provided to the operator during drilling includes drilling parameters, such as WOB, rotational speed of the drill bit and/or the drill string, and the drilling fluid flow rate. In some cases, the drilling operator is also provided selected information about bit location and direction of travel, bottomhole assembly parameters such as downhole weight on bit and downhole pressure., and possibly formation parameters such as resistivity and porosity.

Typically, regardless of the type of the borehole being drilled, the operator continually reacts to the specific borehole parameters and performs drilling operations based on such information and the information about other downhole operating parameters, such as bit location, downhole weight on bit and downhole pressure, and formation parameters, to make decisions about the operator-controlled parameters. Thus, the operators base their drilling decisions upon the above-noted information and experience. Drilling boreholes in a virgin region requires greater preparation and understanding of the expected subsurface formations compared to a region where many boreholes have been successfully drilled. The drilling efficiency can be greatly improved if the operator can simulate the drilling activities for various types of formations. Additionally, further drilling efficiency can be gained by simulating the drilling behavior of the specific borehole to be drilled by the operator.

Commonly, the LWD and MWD tools and sensors are owned and operated by a service contractor. The service contractor makes recommendations from the processed downhole data for adjusting rig operating parameters to achieve desired well plan objectives. Similarly, other service contractors may be providing information concerning the drilling fluids and solids control. Yet another service contractor may be providing underbalanced drilling services. All of these service contractors commonly provide their own separate recommendations regarding the adjustment of various operating parameters to effect a desired change to achieve desired well plan objectives. However, these recommendations must be reviewed by the rig operator to insure that the drilling rig has the capability to execute the recommendations in a safe and efficient manner. Further, these recommendations must be reviewed by other rig personnel, such as the oil company representative, to insure that they are consistent and that they will not adversely impact other aspects of the borehole. For example, it may be desirable to increase the circulating rate of the drilling mud to improve removal of cuttings from the bottom of the borehole. However, this action may cause internal pressures of the borehole to rise above desirable limits resulting in a degradation of the producing capability of the borehole once drilling is completed.

Currently, these recommendations are reconciled through structured or ad hoc meetings among the service contractors, rig operator, and company representative at the rig site. The results of these meetings are communicated to the rig operator to execute. This process is prone to error. For example, instructions may be misinterpreted by the rig operator, or misinterpreted by the drilling crew to which they are communicated, and executed improperly. Or, the instructions may not be passed on correctly to subsequent drilling crews on subsequent work shifts. Or, during the evaluation of the various recommendations, important constraints regarding the capabilities of the rig equipment, or aspects of the well plan such as borehole quality and integrity, or subtle but important incompatibilities among the recommendations, may be overlooked or ignored. Even when such recommendations are successfully resolved and communicated properly to the rig operator, it is still an inefficient process, which wastes potentially productive time in meetings and getting necessary authorizations.

A few systems have been proposed for automated operation of portions of a drilling operation. For example, U.S. Pat. Nos. 6,233,524 and 5,842,149 describe "closed loop" drilling systems in which a number of drilling-related parameters are detected. Thereafter, the system either adjusts automatically based upon these sensed conditions, or prompts an operator to make an adjustment. However, these systems do not provide any mechanism for accommodating more than one person to control various aspects of the drilling operation.

As the "closed loop" systems described illustrate, there is a trend toward greater automation in the drilling process in which multiple parameters that were once controlled manually by a single drilling operator may now be regulated automatically by a computer, albeit with human assistance for programming control parameters and the like of the computer equipment. Despite these advances, though, the location where the control parameters are entered and monitored remains the floor of the drilling rig, and, as a result the driller remains the default operator. As noted above, this arrangement becomes problematic as drilling processes advance in complexity. As noted above, decisions regarding the ideal settings for control parameters are increasingly not made by the driller, and current methods for funneling the needed information to the driller are fraught with difficulties. In fact, mud logging companies, bit companies, and off-site operating company personnel with access to formation and survey data all have the potential to set and alter these drilling parameters to the benefit of the drilling process. Systems are needed that will permit effective and structured use of such drilling equipment.

Thus, there is a need for a system that overcomes the problems associated with the prior art systems.

SUMMARY OF THE INVENTION

The methods of the present invention overcome the foregoing disadvantages of the prior art by providing an automated rig control management system having a hierarchical and authenticated communication interface to the various service contractor and rig operation inputs and using a control model for allocating and regulating rig resources according to operating rules programmed into the control management system to achieve the desired well plan within the operational constraints of the drilling rig equipment and borehole.

In one aspect of the present invention, a method for controlling operation of a drilling rig having a control management system, comprises programming the control system with at least one resource module, the at least one resource module having at least one operating model having at least one set of programmed operating rules related to at least one set of operating parameters. In addition, the method provides an authenticating hierarchical access to at least one user to the at least one resource module.

An example of the system and method of the present invention is described with respect to an autodriller drilling assembly wherein a bit company is permitted selective control over portions of the drilling operation in order to achieve certain goals. The example illustrates the inclusion of safety measures and notifications to drillers and other of changes in control of the drilling assembly.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, wherein:

FIG. 2 is an exemplary list of resource modules an associated operating parameters according to one preferred embodiment of the present invention;

DETAILED DESCRIPTION OF PREFERRED EMBODIMENTS

Figure 1:
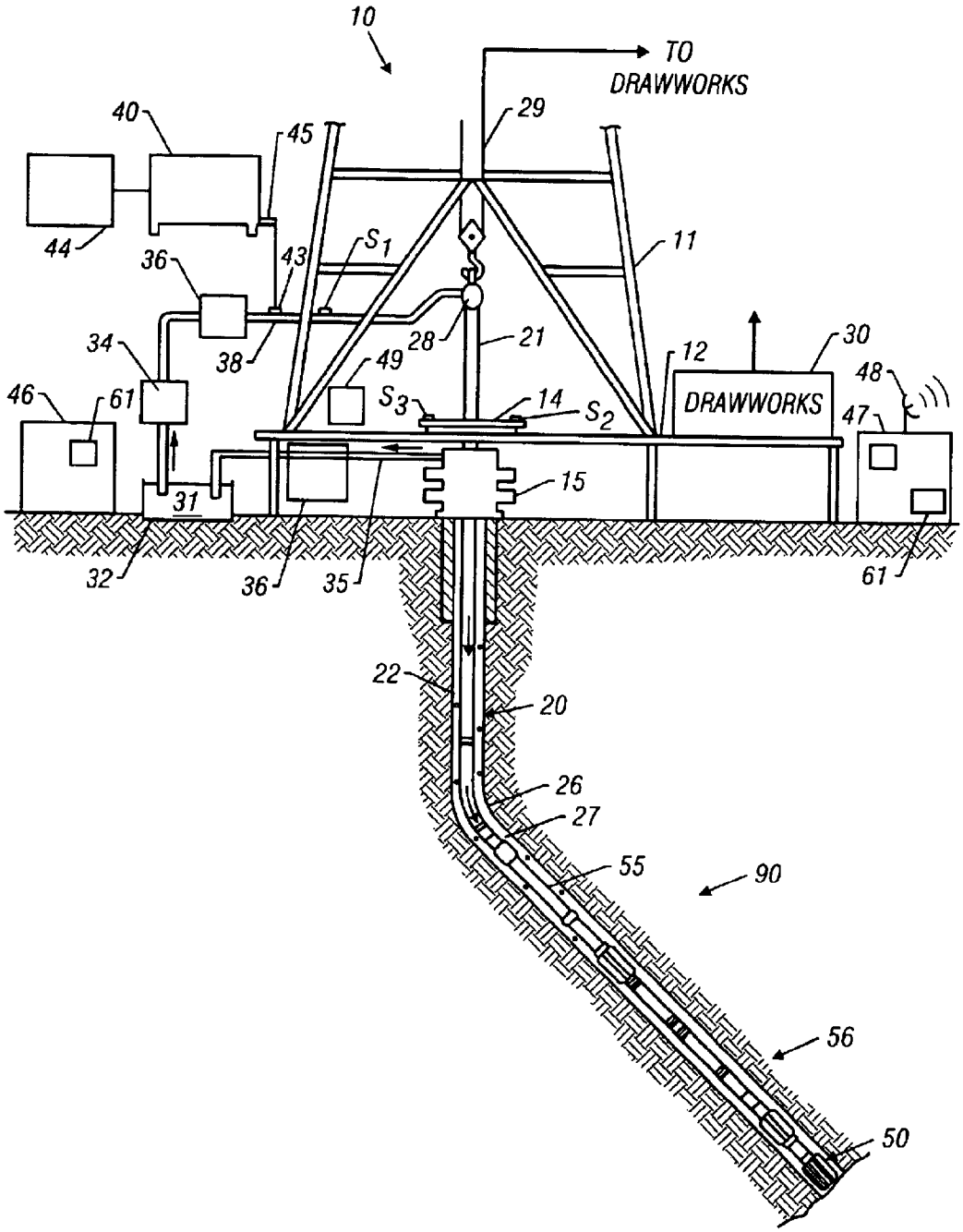
FIG. 1 is a schematic of a drilling system according to one preferred embodiment of the present invention.

FIG. 1 shows a schematic diagram of an exemplary drilling system 10 having a drilling assembly 90 shown conveyed in a borehole 26 for drilling the wellbore. The drilling system 10 includes a conventional derrick 11 having a floor 12 which supports a rotary table 14 that is rotated by a prime mover such as an electric motor (not shown), controlled by a motor controller (not shown) at a desired rotational speed. The motor controller may be a silicon controlled rectifier (SCR) system known in the art. The drill string 20 includes a drill pipe 22 extending downward from the rotary table 14 through a pressure control device 15 into the borehole 26. The pressure control device 15 is commonly hydraulically powered and may contain sensors (not shown) for detecting operating parameters and controlling the actuation of the pressure control device 15. A drill bit 50, attached to the drill string end, disintegrates the geological formations when it is rotated to drill the borehole 26. The drill string 20 is coupled to a drawworks 30 via a kelly joint 21, swivel 28 and line 29 through a pulley (not shown). During the drilling operation the drawworks 30 is operated to control the weight on bit, which is an important parameter that affects the rate of penetration. The operation of the drawworks 30 is well known in the art and is thus not described in detail herein. The previous description is drawn to a land rig, but the invention as disclosed herein is also equally applicable to any offshore drilling systems. Further, various components of the rig can be automated to various degrees, as for example, use of a top drive instead of a kelly, and the invention disclosed herein is equally applicable to such systems. Finally, alternatives to conventional drilling rigs, such as coiled tubing systems, can be used to drill boreholes, and the invention disclosed herein is equally applicable to such systems.

During drilling operations a suitable drilling fluid 31 from a mud tank (source) 32 is circulated under pressure through the drill string 20 by a mud pump 34. The drilling fluid 31 passes from the mud pump 34 into the drill string 20 via a desurger 36, fluid line 38 and the kelly joint 21. The drilling fluid 31 is discharged at the borehole bottom 51 through an opening in the drill bit 50. The drilling fluid 31 circulates uphole through the annular space 27 between the drill string 20 and the borehole 26 and returns to the mud tank 32 via a solids control system 36 and then through a return line 35. The solids control system may comprise shale shakers, centrifuges, and automated chemical additive systems (not shown), that may contain sensors for controlling various operating parameters, for example centrifuge rpm. Much of the particular equipment is case dependent and is easily determinable for a particular well plan, by one skilled in the art, without undue experimentation.

Various sensors are installed for monitoring the rig systems. For example, a sensor $S_1$ preferably placed in the line 38 provides information about the fluid flow rate. A surface torque sensor $S_2$ and a sensor $S_3$ associated with the drill string 20 respectively provide information about the torque and the rotational speed of the drill string. Additionally, a sensor (not shown) associated with line 29 is used to provide the hook load of the drill string 20. Additional sensors (not shown) are associated with the motor drive system to monitor proper drive system operation. These may include, but are not limited to, sensors for detecting such parameters as motor rpm, winding voltage, winding resistance, motor current, and motor temperature. Other sensors (not shown) are used to indicate operation and control of the various solids control equipment. Still other sensors (not shown) are associated with the pressure control equipment to indicate hydraulic system status and operating pressures of the blow out preventer and choke associated with pressure control device 15.

Figure 4:
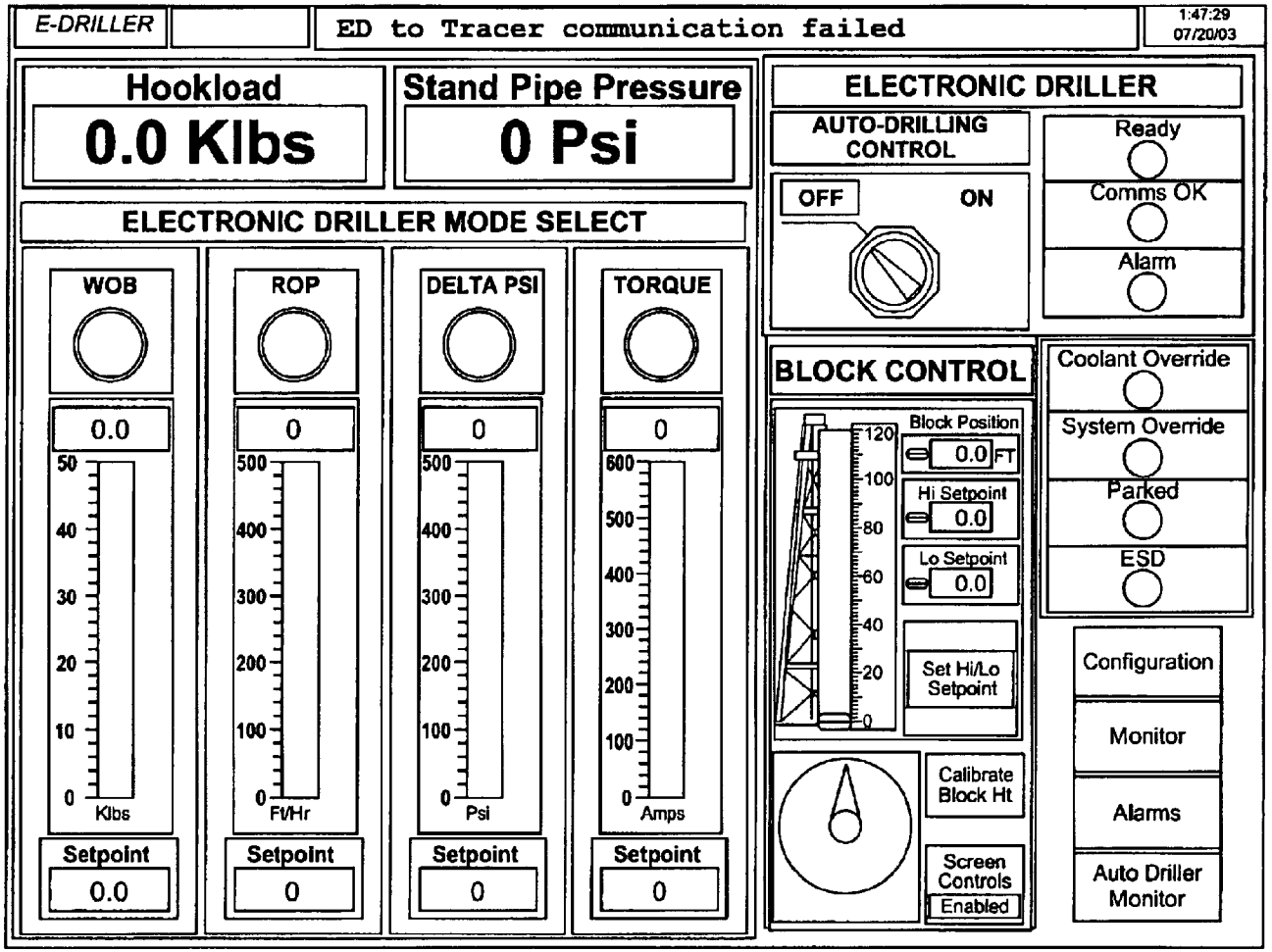
FIG. 4 is an exemplary interactive display screen according to one preferred embodiment of the present invention.

The rig sensor signals are input to a control system processor 60 commonly located in the toolpusher's cabin 47 or the operator's cabin 46. Alternatively, the processor 60 may be located at any suitable location on the rig site. The processor 60 may be a computer, mini-computer, or microprocessor for performing programmed instructions. The processor 60 has memory, permanent storage device, and input/output devices. Any memory, permanent storage device, and input/output devices known in the art may be used in the processor 60. The processor 60 is also operably interconnected with the drawworks 30 and other mechanical or hydraulic portions of the drilling system 10 for control of particular parameters of the drilling process. In one exemplary embodiment, the processor 60 comprises an autodriller assembly, of a type known in the art for setting a desired WOB, and other parameters. The processor 60 interprets the signals from the rig sensors and other input data from service contractors and displays various interpreted, status, and alarm information on both tabular and graphical screens on displays 60, 61, and 49. These displays may be adapted to allow user interface and input at the displays 60, 61, 49. For example, FIG. 4 shows a typical interactive graphical user display that can be adapted for use with this system. Multiple display screens, depicting various rig operations, may be available for user call up. Each display console 60, 61, 49 may display a different screen from the other display consoles at the same time. The interpreted and status information may be compared to well plan models to determine if any corrective action is necessary to maintain the current well plan. The models may suggest the appropriate corrective action and request authorization to implement such corrective actions. The interpreted and status information may also be telemetered using hardwired or wireless techniques 48 to remote locations off the well site. For example, the data from the rig site may be monitored from a company home office.

In some applications the drill bit 50 is rotated by only rotating the drill pipe 22. However, in many other applications, a downhole motor 55 (mud motor) is disposed in the drilling assembly 90 to rotate the drill bit 50 and the drill pipe 22 is rotated usually to supplement the rotational power, if required, and to effect changes in the drilling direction. The mud motor 55 rotates the drill bit 50 when the drilling fluid 31 passes through the mud motor 55 under pressure. In either case, the rate of penetration (ROP) of the drill bit 50 into the borehole 26 for a given formation and a drilling assembly largely depends upon the weight on bit and the drill bit rotational speed.

Drilling assembly 90 may contain an MWD and/or LWD assembly that may contain sensors for determining drilling dynamics, directional, and/or formation parameters. The sensed values are commonly transmitted to the surface via a mud pulse transmission scheme known in the art and received by a sensor 43 mounted in line 38. The pressure pulses are detected by circuitry in receiver 40 and the data processed by a receiver processor 44. Alternatively, any suitable telemetry scheme known in the art may be used.

Commonly, the MWD or LWD tools and sensors are owned and operated by a service contractor. The service contractor makes recommendations from the processed downhole data for adjusting rig operating parameters to achieve desired well plan objectives. Similarly, other service contractors may be providing information concerning the drilling fluids and solids control. Yet another service contractor may be providing directional drilling service. All of these service contractors, in addition to the rig operator, commonly provide their own separate recommendations regarding the adjustment of various operating parameters to effect a desired change to achieve desired well plan objectives. These recommendations may be conflicting. FIG. 2 shows a limited example list of rig operating parameters and how they may be associated with the resource modules to control various operations, according to one preferred embodiment. For example, "pump strokes" is related to the pumping flow rate and is associated, in one preferred embodiment, with multiple resource modules, such as Pressure Management, Solids Control, and Downhole MWD Tool control. In one set of exemplary circumstances, the flow rate may need to be increased in order to improve the removal of cuttings from the borehole. However, the pressure management control system may require a limitation on the flow rate to preserve the producibility of the borehole. Therefore, it is clear that there may be conflicting requirements for various rig operating parameters. Many more resource modules may be contemplated by those skilled in the art.

Figure 3:
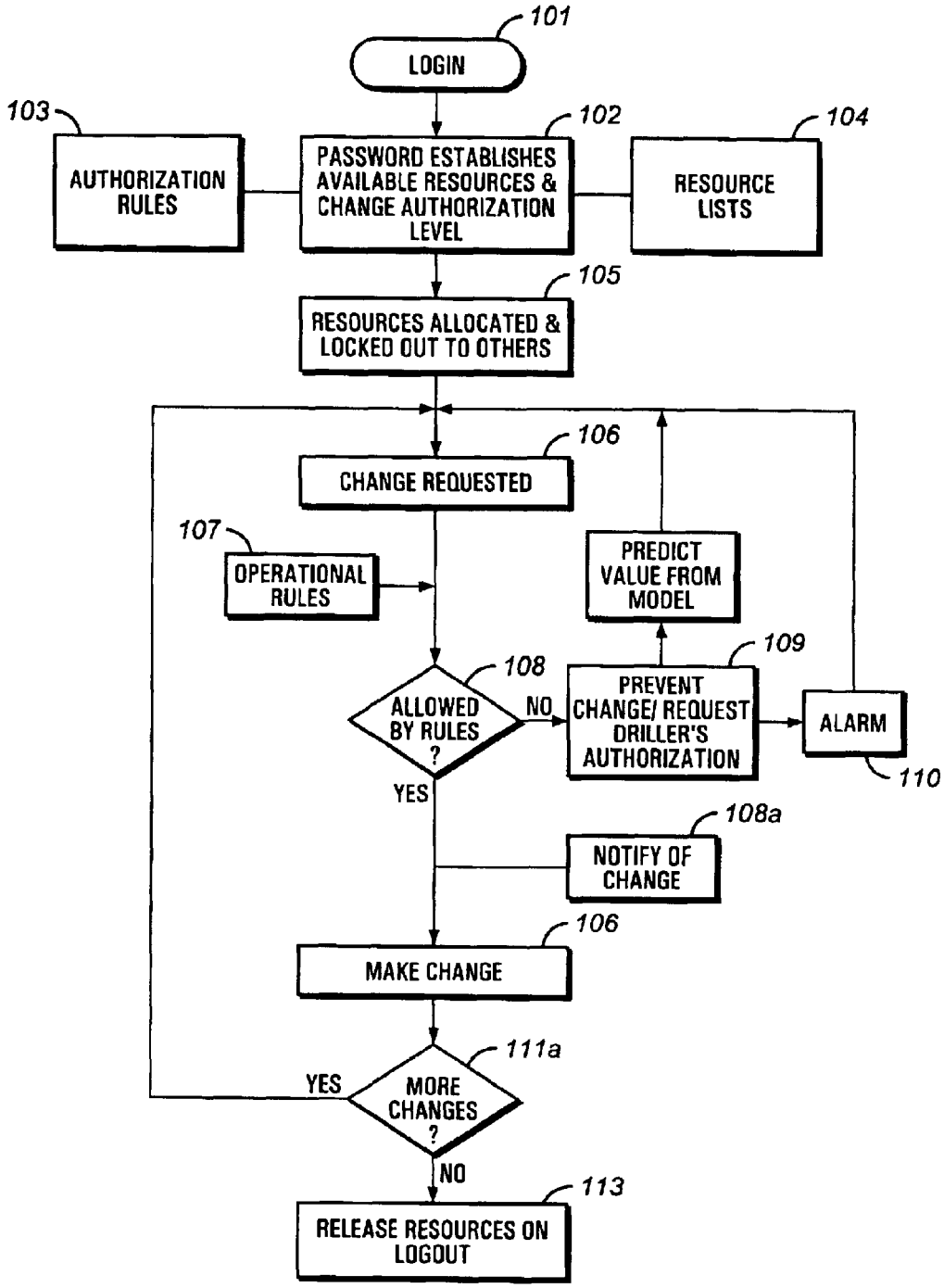
FIG. 3 is a flow chart of the control system operation according to one preferred embodiment of the present invention.
Figure 5:
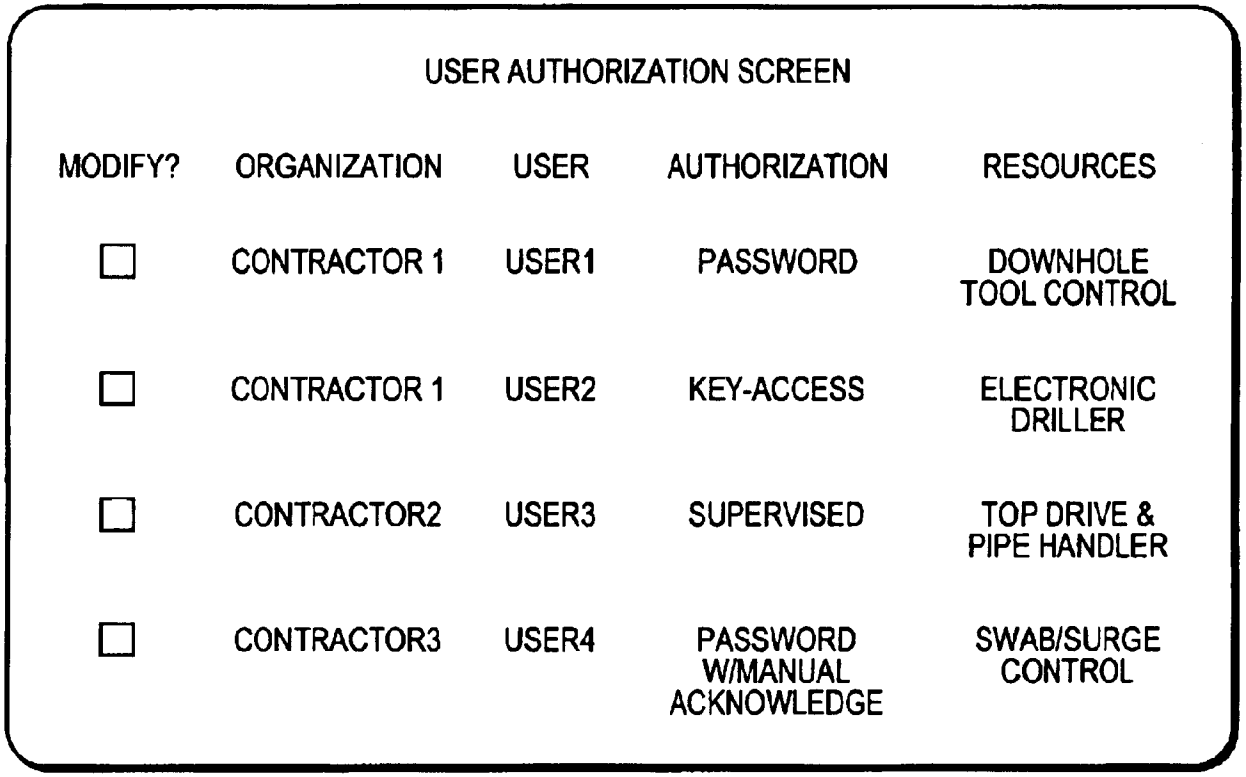
FIG. 5 is an exemplary interactive display screen according to one embodiment of the present invention.

In one preferred embodiment, see FIG. 3, a user logs in 101 to the system at one of the consoles. The user logs in using an authentication technique that may include, but not be limited to, at least one of (i) a password, (ii) a physical key, (iii) a radio frequency identification device, (iv) a fingerprint device, (v) a retinal scan device, and (vi) a digital software key. Any other suitable technique may be used for authentication. For example, a password is programmed into the control system to recognize the user and to determine the resources available to the user 104 and the ability of the user to effect an adjustment in a rig operating parameter 103. For example, FIG. 4 shows a hierarchical user authorization table that may be programmed into the control management system. As seen in FIG. 5, different users have access to different resources and also require different levels of authorization to effect changes. For example user 1 has authorization to change Downhole Tool Control parameters by Password authorization. User 4, however, requires a Password and Manual Acknowledgement to effect a change in Surge/Swab parameters. In a situation where multiple users seek access to the same resources, the hierarchical authorization table, programmed into the control processor, also determines the sequence in which each requesting user receives access to the desired resource. For example, a drilling supervisor may typically override other user access. Referring to FIG. 3, once a resource module is allocated to a user, an interlock system prevents other users from accessing that particular resource module. In addition, the interlock system prevents other users from adjusting operating parameters in other resource modules that could potentially change, directly or indirectly, operating parameters within the checked out resource module, until the original resource module has been released by the present user 105. Blocked out parameters and resource modules are typically still available for viewing on a read-only basis. An example of a conflict of directly adjusting operating parameters in another resource module is the aforementioned "pump strokes" example. Pump strokes are included as an operating parameter in multiple resource modules. Each of these modules may be allocated to a different user at one time. The operating rules and the interlock system establish priorities for determining which module gets access to pump strokes. The priorities are operationally dependent. In an indirect impact on an operating parameter, a first operating parameter in a first allocated resource module is affected by a change in a second operating parameter in a second allocated resource module. For example, pump discharge pressure may be an operating parameter in a first resource module and mud weight in a second resource module. While not representing a direct conflict, changes in mud weight, as is commonly known, can cause changes in bottom hole pressure. The operating rules and interlock system are developed to prevent such indirect conflicts.

Referring again to FIG. 3, the user requests a change in a parameter 106. The change is compared to the operational rules 107. The operational rules 107 comprise rules related to rig and equipment capabilities and to the well plan objectives. For example, the user may request to change pump strokes beyond the limit of the pump. The operational rules 107 would indicate an out of range status request. In another example, the change may be within the rig capabilities but would cause a situation that would jeopordize the well plan by creating too high a flow rate and causing damage to the borehole. The rules may also be adaptive and/or use fuzzy logic techniques known in the art. For example, the system may have a rule to detect sudden variations in pump discharge pressure. A sudden decrease in discharge pressure, without stopping the pump, may indicate a pump problem. A sudden increase may indicate a flow blockage. An alarm band may be established about the nominal pump discharge pressure. However, normal rig operations may dictate varying the nominal discharge pressure. The alarm band must adapt to keep the changing nominal discharge pressure in the same relative position inside the alarm band. Alternatively, the rules may comprise an Expert System of rules generated, for example, based on similar well operations and well plans. The rules may be updated at the rig site.

Still referring to FIG. 3, if the parameter change request 106 is acceptable, then the change is made 111, with proper authorization, and the resources are released when the user logs out 113. If the parameter change request 106 is permitted, a notification 108*a* is provided to all users on the system. If the change is not acceptable, the system prevents the change from occurring 109 and an alarm is initiated 110. If a predictive model is programmed into the control management system, a predictive value is suggested 112 for use input as a requested change 106 and again compared to the operational rules 107. If the change is authorized, the change is made 111, and the resources are released as the user logs out 113. In an intermediate step, 111*a* in FIG. 3, the system checks to determine if there are additional changes to be made before releasing the resources on logout (step 113). If so, the system returns to the 'change requested' block 106 and the subsequent steps of the process are repeated. The access table and the authorization levels may be programmed into the system at a central office and may be modified at the rig site. Alternatively, the access table and authorization levels may be input and modified at the rig site.

The system, as described above, provides for manual user access. Alternatively, access may be electronically established from a service contractor computer on a communication channel. The communication channel may be hardwired, optical, or any wireless system. The communication access may be continuous or an on-demand basis. The authorization may be high security digital passwords similar to those commonly used for internet transactions. Such systems are commercially available. The system will still detect out-of-range adjustment requests and handle these anomalies as described previously with regard to manual out-of-range requests. The system may automatically suggest a corrected request.

In another preferred embodiment, the operating rules and model may form a neural network for controlling the rig. Neural networks are well known in the art and commercial systems are available to assist in their setup. In one example, the various sensor inputs may be inputs to the neural network that has a desired target rate of penetration along a predetermined well path. The neural network iteratively adjusts weighting parameters, associated with nodes within the network, to "learn" the appropriate control settings for the various operating parameters to achieve the desired objective.

In another preferred embodiment, the present invention is implemented as a set of instructions on a computer readable medium, comprising ROM, RAM, CD ROM, Flash or any other readable medium, now known or unknown that when executed cause a computer to implement the method of the present invention.

Figure 6:
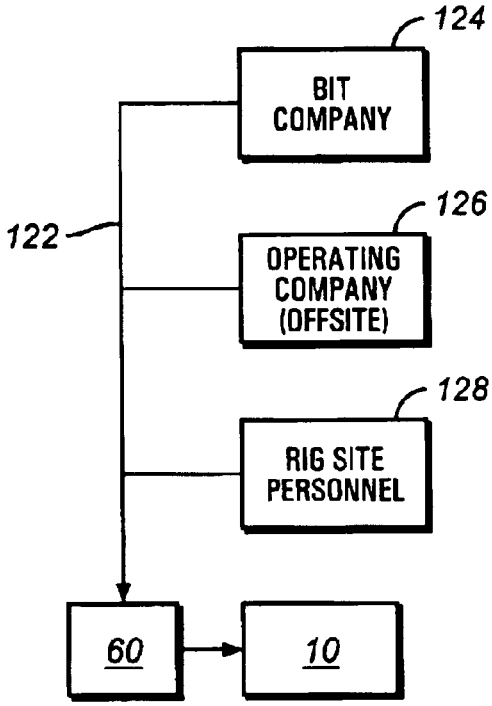
FIG. 6 is a schematic diagram illustrating a multi-level hierarchical control scheme for the control of drilling system 10.

An operational example of a multi-level hierarchical rig control management system 120 and associated methods of the present invention is further provided with the assistance of FIG. 6. The controller 60 in the form of or contained in an autodriller, of a type known in the art, and, thus, these two terms will hereinafter be used substantially interchangeably. The controller/autodriller 60 is shown in FIG. 6 to be operably associated with the drilling system 10. There is a networked computer system 122, which is interconnected using the devices described earlier, principally, the displays for 60 as well as 61, 49 and others, hardwired or wireless network connections 48, and suitably programmed routers, computers and other devices of types well known in the art for forming such a networked computer system. We will refer to the computer system 122 as the Automated Rig Management Control System (ARMCS), that interconnects the bit company 124, offsite operating company personnel 126, and rig site personnel 128 together. This example assumes that the bit company 124, having drilling optimization expertise, has been put in charge of choosing the drilling parameters for the autodriller 60 such that the drilling process for the drilling system 10 will be managed optimally. Autodrillers are well known in the art and allow a driller to set a desired Weight on Bit (WOB). Thereafter, the autodriller will pay out line 29 from the drawworks 30 as needed to maintain the WOB. Today, there exist more sophisticated drawworks that allow a driller to additionally set a maximum ROP, which is effectively the maximum rate of pay out of line 29, as well as parameters of torque and pump pressure. Many autodrillers also allow the line 29 to be reeled back onto the drum, effectively raising the BHA 50.

In this example, it is desired to notify off-site operating company personnel 126 and rig site personnel 128 whenever the bit company 124 is proposing to control (or release control of) the drilling process by drilling system 10. Additionally, it is desired to inform rig site personnel 128, and specifically the driller, whenever parameters are changed by more than a predetermined amount, and to further require that such non-minor changes be authorized by the driller, who is present among the rig site personnel 128. According to this example, it should not be possible for any operator of the drilling equipment (i.e., persons from the rig company 124, operating company 126, or rig site personnel 128) to command the drilling system 10 to perform an action that is either dangerous or physically impossible for the drilling arrangement to perform. For instance, if one were to attempt to command the controller 60 to increase the WOB to eight billion pounds, a clearly unrealistic number, the change would be prevented according to the decision making blocks 108 and 109 from FIG. 3. In this example, assume that the bit company 124 will want to take control of the drilling arrangement in order to set the WOB target so as to maximize the ROP for the given bit type. However, it is also desired to limit the ROP to a maximum value in order to insure that fluids circulating in the borehole are able to effectively transport drill cuttings up from the bit 50.

Through the ARMCS network 122, the bit company 124 will request access to specifically request use and control of the autodriller 60. The ARMCS 122 has been preprogrammed with the policies and desires outlined above, to wit, (1) that the bit company 124 is allowed control of the autodriller 60; and (2) that the offsite operating company personnel 126 and the rig personnel 128 be notified whenever the bit company 124 is proposing to control (or release control of) the autodriller 60. Hence, the ARMCS authorization rules 103 allow the bit company 124 to log onto the system by using, for example, a password issued to the bit company from the operating company, as shown in block 102 of FIG. 3. In accordance with the preprogrammed rules, the ARMCS 122 sends a message to the off site operating personnel and the rig personnel that the bit company is proposing to control the autodriller. The ARMCS 122 further checks to insure that the autodriller 60 is available for control (block 105 in FIG. 3). For example, the rig site driller 128 might have the autodriller 60 reserved for his use. In that case, it would be necessary for the driller 128 to release the autodriller 60 prior to the bit company 124 taking control of it. Assuming that the autodriller 60 is available for control, the ARMCS 122 allows the bit company 124 to take control of the autodriller 60.

At this point, the bit company 124 can use a display screen (not shown) similar to the one shown in FIG. 4 to display the parameters for the autodriller 60, and an input device (keyboard, etc.) specifically setting targets for WOB and ROP. Once these values are entered, the ARMCS 122 applies a set of operational rules 107 (see FIG. 3) to determine if it can indeed allow such parameters to be set. According to the operational rules 107, if the proposed values for ROP and WOB differ by more than a predetermined amount, such as a pre-established percentage, the rig site driller 128 is notified and requested to give authorization 109 for the change to be made. Further, ARMCS 122 will check to ensure that the values entered for WOB and ROP are physically possible to execute and do not present a danger to the rig or the rig personnel. For example, it is possible that the bit company might erroneously program a target of 300,000 pounds of WOB. This much weight would crush many bits, and hence, the ARMCS 122 would be preprogrammed to disallow such a change 109 and, instead, send an alarm 110 to the bit company 124 to that effect.

Once the bit company 124 no longer needs to control the autodriller 60, it issues a request to the ARMCS 122 to release the autodriller 60, as indicated at block 113 in FIG. 3. In accordance with the operational rules 107 detailed above, off site operating company personnel 126 and rig personnel 128 are notified that the bit company 124 is releasing control of the autodriller 60. At that point, the autodriller 60 becomes available for another authorized user to take control of it. The bit company 124 can, thus, control aspects of the drilling process of the drilling system 10 without requiring setting of drilling parameters by the driller. Further, the physical location of the bit company personnel 124 is not significant. They may be located at the rig or away from the rig, but with remote access.

While the above example has been applied to control of an autodriller 60, and specifically the WOB provided by an autodriller 60, it should be apparent that the system and methods of the present invention may be applied to other rig equipment via remote control of such equipment. For example, solids control equipment might be controlled remotely by drilling fluid experts who are capable of determining which mud processing equipment and what additives could be most beneficially added to optimize the drilling process. In another example, geosteering tools could be controlled from a remote site wherein the controllers have significant geosteering expertise and/or greater access to relevant formation data.

Figure 7:
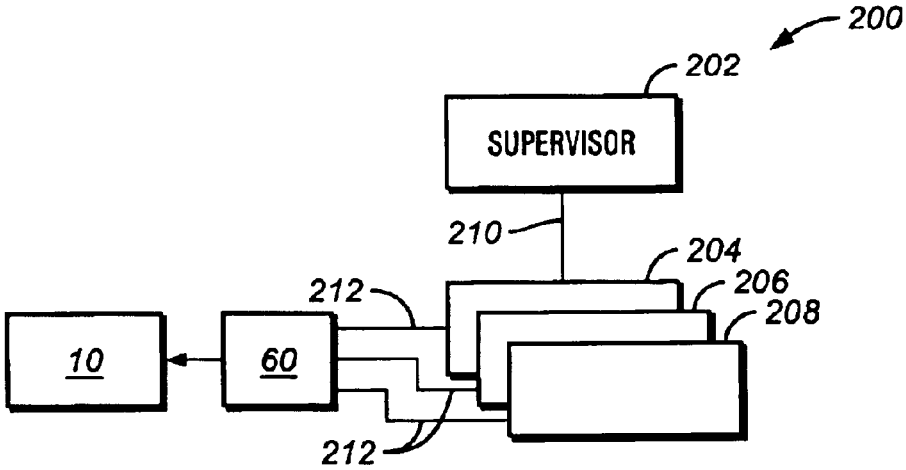
FIG. 7 is a schematic diagram of a further exemplary multi-level hierarchical control scheme for the control of the drilling system 10.

FIG. 7 illustrates, in schematic fashion, a further exemplary hierarchical scheme 200 for the control of the autodriller 90 described earlier. In this embodiment, there is a supervising control entity 202 that is in overall control of several subordinate entities 204, 206, 208, each of which has control (as depicted by line 210) over one or more aspects of the operation of the autodriller 90, as indicated by the lines 212 in FIG. 7. The control indicated by lines 212 is meant to indicate the presence of network rights via the ARMCS networked computer system 122, as described earlier. The control indicated by line 210 is meant to indicate supervisory network control rights. The supervisory control entity 202 may be any of the previously listed entities, i.e., the driller located at the rig site 128, bit company 124, operating company 126, or other entity. Similarly, the subordinate entities 204, 206, 208 may be any of those same entities. In operation, any of the subordinate entities 204, 206, 208 may establish control over some aspects of the control of drilling system 10 via autodriller 90, in a manner described previously. However, the supervisory control entity 202 will retain the ability to maintain overall control of the drilling system 10 by selectively locking out the control 212 of one or more of the individual subordinate entities 204, 206, 208. For an example, consider that the rig site driller is the supervisory entity 202, subordinate entity 204 is the bit company, and entities 206, 208 are off-site persons associated with the operating company. Were the bit company 204 to attempt to set the WOB remotely to too great an amount, the supervisory entity 202 could terminate the control 212 that the bit company 204 would have with respect to the autodriller 90. With respect to the diagram indicated at FIG. 3, this could occur once the bit company 204 requested the change at block 106. The operational rules 107 would require that the supervisory entity 202 grant approval for the WOB to be adjusted. When such a change is denied by the supervisory entity 202, control of the WOB would revert to the supervisory entity 202.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A method for controlling operation of a drilling rig having a control system, comprising:

a) programming said control management system with at least one resource module associated with at least one set of operating parameters, said at least one resource module having at least one operating model having at least one set of programmed operating rules related to the at least one set of operating parameters;

b) providing an authenticating hierarchical access to at least one user to the at least one resource module;

c) allowing said at least one user to input an adjusted value for at least one of the set of operating parameters in the at least one resource module;

d) comparing said adjusted value to said at least one set of programmed operating rules and allowing adjustment if said adjusted value is within said operating rules;

e) providing an indication if said adjusted value is not within said operating rules; and f) providing a supervisor override to prevent acceptance of said adjusted value.

2. The method of claim 1, wherein the authenticating hierarchical access is programmed at the rig site.

3. The method of claim 1, wherein a first allocated resource module having a first set of operating parameters is accessible to only one user at a time.

4. The method of claim 2, further comprising an interlock system preventing adjustment of an operating parameter of a second set of operating parameters of a second allocated resource module where said operating parameter of said second set of operating parameters is the same as an operating parameter of said first set of operating parameters.

5. The method of claim 2, further comprising an interlock system preventing adjustment of an operating parameter of a second set of operating parameters of a second allocated resource module where said operating parameter of said second set of operating parameters is indirectly related to an operating parameter of said first set of operating parameters.

6. The method of claim 1, further comprising requiring supervisor approval to accept said adjusted value.

7. The method of claim 1, further comprising providing remote access for communicating to the control system.

8. The method of claim 1, further comprising displaying said at least one set of operating parameters in at least one remote location.

9. The method of claim 1, wherein the authenticating hierarchical access comprises using at least one of (i) a password, (ii) a physical key, (iii) a radio frequency identification device, (iv) a fingerprint device, (v) a retinal scan device; and (vi) an digital software key.

10. The method of claim 1, wherein the at least one model and the at least one set of operating rules form a neural network for controlling the rig.

11. The method of claim 1, wherein the at least one set of operating rules are an expert system.

12. A computer readable medium containing instructions that when executed cause a processor to control operation of a drilling rig according to the following method, comprising;

a) programming said control system with at least one resource module, said at least one resource module having at least one operating model having at least one set of programmed operating rules related to at least one set of operating parameters; and b) providing an authenticating hierarchical access to at least one user to the at least one resource module.

13. The computer readable medium of claim 12, further comprising allowing said at least one user to input an adjusted value for at least one of the set of operating parameters in the at least one resource module.

14. The computer readable medium of claim 12, further comprising comparing said adjusted value to said at least one set of programmed operating rules and allowing adjustment if said adjusted value is within said operating rules, otherwise preventing adjustment of said value.

15. The computer readable medium of claim 12, further comprising providing an indication if said adjusted value is not within said operating rules.

16. The computer readable medium of claim 12, further comprising providing a supervisor override to prevent acceptance of said adjusted value.

17. The computer readable medium of claim 12, wherein the authenticating hierarchical access is programmed at the rig site.

18. The computer readable medium of claim 12, wherein the at least one resource module is accessible to only one user at a time.

19. The computer readable medium of claim 12, further comprising requiring supervisor approval to accept said adjusted value.

20. The computer readable medium of claim 12, further comprising providing remote access for communicating to the control system.

21. The computer readable medium of claim 12, further comprising displaying said at least one set of operating parameters in at least one remote location.

22. The computer readable medium of claim 12, wherein the at least one model and the at least one set of operating rules form a neural network for controlling the rig.

23. The computer readable medium of claim 12, wherein a first allocated resource module having a first set of operating parameters is accessible to only one user at a time.

24. The computer readable medium of claim 23, further comprising an interlock system preventing adjustment of an operating parameter of a second set of operating parameters of a second allocated resource module where said operating parameter of said second set of operating parameters is the same as an operating parameter of said first set of operating parameters.

25. The computer readable medium of claim 23, further comprising an interlock system preventing adjustment of an operating parameter of a second set of operating parameters of a second allocated resource module where said operating parameter of said second set of operating parameters is indirectly related to an operating parameter of said first set of operating parameters.

* * * * *